United States Patent [19]

Verdollin

[11] 4,167,094

[45] Sep. 11, 1979

[54] SPINDLES FOR TWISTING MACHINES

[75] Inventor: Jacques Verdollin, Saint Andre de Corcy, France

[73] Assignee: Verdol S.A., Caluire, France

[21] Appl. No.: 899,947

[22] Filed: Apr. 25, 1978

[30] Foreign Application Priority Data

Apr. 28, 1977 [FR] France ..... 77 14141

[51] Int. Cl.[2] ..... D01H 7/86

[52] U.S. Cl. ..... 57/58.72; 57/58.83

[58] Field of Search ..... 57/58.49, 58.72, 58.74, 57/58.76, 58.83, 58.84, 58.86

[56] References Cited

U.S. PATENT DOCUMENTS

| | | | |
|---|---|---|---|
| 2,521,601 | 9/1950 | Planet | 57/58.72 |
| 2,541,541 | 2/1951 | Pellat-Finet et al. | 57/58.72 |
| 2,587,758 | 3/1952 | Pellat-Finet et al. | 57/58.72 |
| 2,873,570 | 2/1959 | Sage | 57/58.72 |
| 3,296,787 | 1/1967 | Maurin | 57/58.72 |
| 3,546,871 | 12/1970 | Ratti | 57/58.49 |

*Primary Examiner*—John Petrakes
*Attorney, Agent, or Firm*—Dowell & Dowell

[57] ABSTRACT

A spindle for twisting frames comprises a stabilization whorl at an angle to the shaft of said spindle intended to maintain the bobbin-carrying and piece angularly fixed. The whorl is a single block formed with a radial bore therein which is traversed with clearance by a member formed on a rotating flange connected to the spindle axis and which holds the usual disk for driving the thread to be twisted.

6 Claims, 2 Drawing Figures

SPINDLES FOR TWISTING MACHINES

The present invention relates to improvement in spindles for twisting frames and more particularly double twist spindles.

The general arrangement of a double twist spindle which is very well known in the art will not be described here. However, it is to be recalled that the bobbin from which the thread is unwound to undergo the double twist operation must be stationary on the end of the rotating shaft of the spindle. The bobbin support is therefore mounted for free rotation with respect to the upper end of the said shaft and immobilized by different means such as an unbalance, an electromagnetic device or a mechanical system. The latter is here adopted. This system comprises a stabilization whorl or block mounted at an angle with respect to the axis of the spindle but driven into rotation thereby, and the whorl cooperates with the bobbin carrier end-piece. Since the geometrical axes of the latter and of the whorl are not in line the spindle shaft cannot drive the bobbin holder which abuts on the whorl.

The whorl is usually made up of two parts united by small columns between which a tube extends, the said tube being connected to a hub rotating with the spindle and having an inner passageway therein communicating with the mouth of the shaft bore in which the thread passes, coming from the bobbin in order to be twisted.

It is easily understood that the realization of the whorl is complex and therefore expensive.

The improvements which are the object of the present invention are intended to make it less expensive by producing the whorl as a single block which is associated with drive means connected to the spindle and supporting the usual disk disposed under the bobbin.

The invention will be best understood from the description which follows and from the accompanying drawings, which description and drawings, given particularly by way of indication, will also make apparent other advantages and objectives and also the important characteristics of the invention, of which the main ones are also defined in the accompanying claims.

Figure 1:
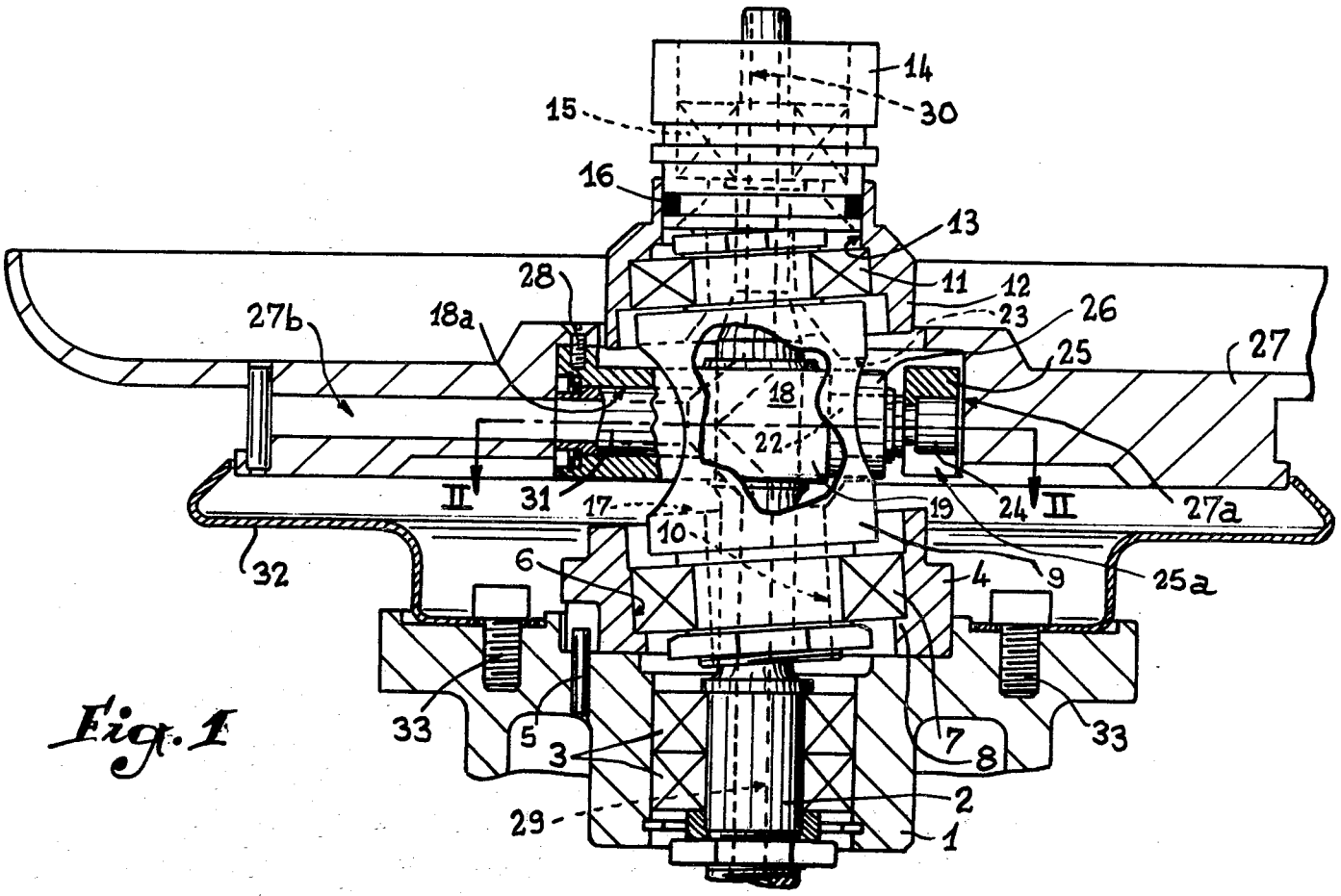
FIG. 1 is a partial longitudinal cross-section of a double twist spindle to which the improvements according to the invention are applied.

The spindle illustrated in FIG. 1 comprises a fixed body 1 in which a hollow shaft 2 is rotatably mounted on ball bearings 3. The body is connected by force fit with a tubular bush 4, a pin 5 therein preventing rotation. There is provided a stepped bore in the bushing 4, this bore being orientated obliquely with respect to the shaft 2, and having a central seat 6 therein on which the outer race of a ball bearing 7 is mounted, this bearing resting on a shoulder portion 8. The inner cage of bearing 7 is fitted on the lower end of a whorl 9 which is traversed by the shaft 2 through a bore 10 provided therein.

The upper end of the whorl 9 is mounted in a bearing 11 so as to permit its free rotation with respect to a bearing block cover 12. The cover 12 has the same orientation as the whorl but its upper mouth has a bore 13 therein coaxial to shaft 2. The bore 13 receives the lower cylindrical portion of an end piece 14 mounted on the upper end of shaft 2 by means of a ball bearing 15. It is to be noted that an Oring 16 is placed around the end-piece 14 so that the connection of the latter with the whorl 9 must be considered as slightly resilient.

Figure 2:
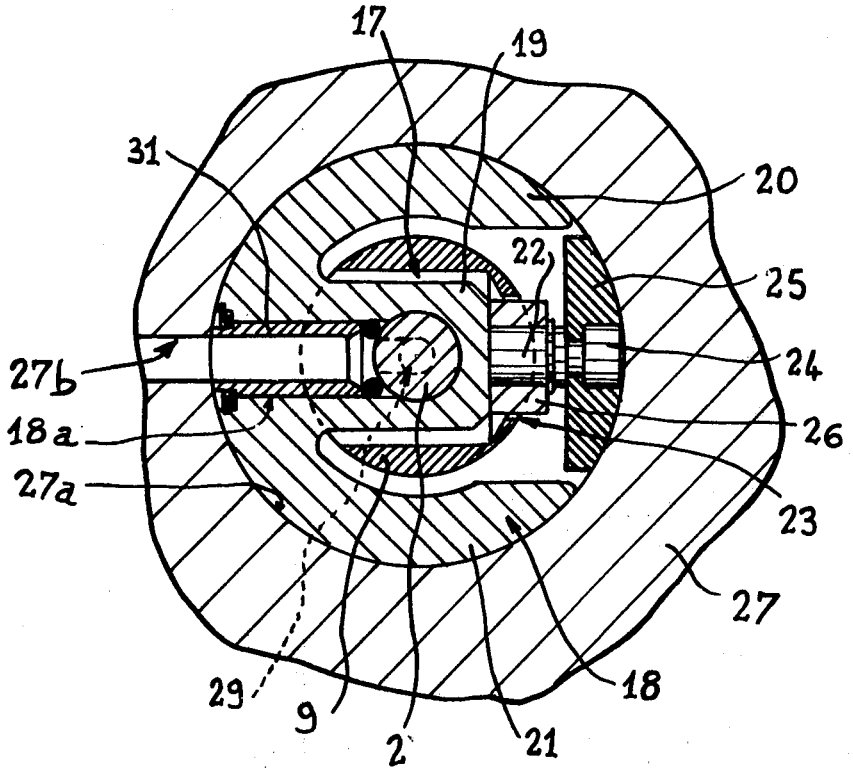
FIG. 2 is a cross-sectional view taken along to line II—II in FIG. 1.

The whorl is formed with a transverse passageway 17 perpendicular to the bore 10 and in which a plate or flange 18 is introduced, the profile of this flange being best illustrated in FIG. 2. Flange 18 comprises a central hub portion 19 which extends outwardly (on the left-hand side of FIG. 2) into two curved arms 20, 21 which partly embrace the whorl 9 so as to define an outer cylindrical face. In other words the flange 18 is roughly in the form of an anchor having both a central portion engaging the passageway 17 of the whorl 9 and arms partly surrounding the latter with a substantial clearance. The hub portion 19 extends into a boss 22 which traverses an orifice 23 in the whorl, this orifice forming an extension of passageway 17. At the end of this boss there is disposed a head 24 on which a counterweight 25 is mounted for balancing the flange 18. The boss 22 might have dimensions slightly smaller than those of orifice 23. However, a wear bushing 26 made for instance of a suitable plastic material is preferably interposed around the boss. The flange 18 is secured to shaft 2 by any suitable means so that it can rotate with it. In view of this, its bushing 26 drives the whorl into rotation by bearing on one of the edges of orifice 23. The bore through the whorl is such that the said whorl can rotate without engaging shaft 2, i.e. the diameter of the bore 10 is such as to permit that motion. Of course, upon rotation of the spindle the whorl effects a relative vertical displacement with respect ot the flange 18 so that the opening 23 must be high enough to permit such displacement.

As well known in the art the end piece 14 cannot rotate with respect to the spindle 2 because its geometrical axis is directed obliquely with respect to that of the whorl and due to the fact that the latter cooperates with the end piece, as shown hereinabove, through the O-ring 16.

The side face of the counterweight 25 is of a diameter equal to that of the outer edge of arms 20, 21 of flange 18 so that the conventional disk 27 having a central bore **27*a* therethrough can be mounted about the flange-counterweight assembly. Screws such as at 28 are used for connecting disk 27 to flange 18**.

In a per se known manner, the shaft 2 of the spindle is formed with opposite longitudinal bores 29, 30 therein which open obliquely to the periphery of shaft 2 approximately in the middle of the height of flange 18. At the same level the flange has a lateral hole **18*a* formed therein and which communicates with a radial cavity 27*b* formed in disk 27. A lining 31 is laid in the radial hole 18*a***.

It is easily understood that after disconnection of disk 27 and flange 18, and if that means for readily dismounting the counterweight 25 are provided, replacement of the wear bushing 26 is easily effected by mere sliding. For this purpose, the counterweight has an aperture **25*a* opening downwardly in which head 24** is lodged.

There also provided a circular deflector 32 secured to body 1 by means of screws 33 and the end of which lies level with the lower portion of disk 27. When the thread breaks, the deflector 32 prevents its free end from becoming wound about the whorl 9.

Furthermore, it has to be understood that the foregoing description has only been given by way of example and that it does not in any way limit the scope of the invention, from which there would be no departure if the constructional details as described are replaced by any other equivalents.

What is claim is:

1. An improved double-twist spindle mechanism of the type having a shaft rotatably supported in a fixed body, and the shaft supporting a thread bobbin carrier rotatably mounted on the top thereof, and the shaft having a hollow axial thread-receiving bore communicating with a radial thread exit bore in the shaft below the bobbin, the mechanism comprising:

means connected to the thread bobbin carrier for supporting an upper bearing, and means carried by the fixed body supporting a lower bearing, the bearings surrounding the shaft respectively above and below said thread exit bore, and the bearings being mutually aligned along a whorl axis which is disposed at an acute angle to the axis of the shaft;

an annular whorl member surrounding the shaft and supported at its ends by said upper and lower bearings, the whorl member having a passageway extending therethrough transversely of said whorl axis and opposite to said thread exit bore of the shaft;

a thread driving disc surrounding the whorl member and having a radial cavity opposite to said thread exit bore; and a flange plate fixed to the disc outside the whorl member, and having a central portion extending inwardly through the passageway of the whorl member and mounted on the shaft, the central portion supporting the disc for rotation with the shaft with the radial cavity of the disc communicating with the thread exit of the shaft.

2. The mechanism as claimed in claim 1, wherein the central portion of the flange plate extends into said passageway in the whorl member and is smaller in cross-section than the cross-section of said passageway, and the mechanism further including a wear bushing surrounding said central portion and interposed between it and said passageway, the wear bushing being a sliding fit on the central portion to facilitate changing thereof.

3. The mechanism as claimed in claim 1, wherein the thread driving disc has a central opening surrounding the whorl member, and the flange plate includes semicircular arm portions partially surrounding said whorl member and fitting said central opening and removably secured to the disc thereat, the central portion of the flange plate extending toward the shaft between said arm portions.

4. The mechanism as claimed in claim 3, wherein the central portion of the flange plate extends through the passageway of the whorl member beyond the shaft; and the mechanism further including a counter weight removably fixed to the free end of the central portion and having a mass operative to counterbalance the weight of said arm portions of the flange plate.

5. The mechanism as claimed in claim 1, wherein the central portion of the flange plate is fixed to the shaft at a location where it covers the thread exit bore of the shaft, and said central portion having a radially extending hole communicating at its inner end with said thread exit bore and at its outer end with the radial cavity of the disc.

6. The mechanism as claimed in claim 5, wherein the radially extending hole of the central portion is exposed when the disc is removed from the flange plate; and a lining member inserted in the radially extending hole to pass the thread therethrough.

* * * * *